US011597625B2

(12) United States Patent
Adachi et al.

(10) Patent No.: US 11,597,625 B2
(45) Date of Patent: Mar. 7, 2023

(54) MECHANISM FOR WINDING CORD

(71) Applicant: Panasonic Intellectual Property Management Co., Ltd., Osaka (JP)

(72) Inventors: Haruka Adachi, Osaka (JP); Mitsuhiro Tosa, Osaka (JP); Keiichi Taketani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 148 days.

(21) Appl. No.: 17/160,632

(22) Filed: Jan. 28, 2021

(65) Prior Publication Data

US 2022/0234863 A1 Jul. 28, 2022

(51) Int. Cl.
*B65H 75/44* (2006.01)

(52) U.S. Cl.
CPC ..... *B65H 75/4402* (2013.01); *B65H 2701/34* (2013.01)

(58) Field of Classification Search
CPC . B65H 75/44; B65H 75/4402; B65H 2701/34
See application file for complete search history.

(56) References Cited

U.S. PATENT DOCUMENTS

| | | | | |
|---|---|---|---|---|
| 3,626,495 | A * | 12/1971 | Bastian, Jr. | B65H 75/06 242/407 |
| 6,109,957 | A | 8/2000 | Fladung | |
| 6,616,080 | B1 * | 9/2003 | Edwards | B65H 75/4449 242/378.1 |
| 6,780,021 | B1 * | 8/2004 | Owen | H01R 39/64 439/35 |
| 9,174,712 | B2 * | 11/2015 | Klotz | B63C 9/082 |
| 10,230,200 | B1 * | 3/2019 | Tomasko | B65H 75/4471 |
| 2018/0093852 | A1 * | 4/2018 | Morey | B65H 75/4452 |

FOREIGN PATENT DOCUMENTS

| | | |
|---|---|---|
| JP | 2001-513979 | 9/2001 |
| JP | 2012-206809 | 10/2012 |

* cited by examiner

*Primary Examiner* — Sang K Kim
(74) *Attorney, Agent, or Firm* — Wenderoth, Lind & Ponack, L.L.P.

(57) ABSTRACT

A mechanism for winding a cord includes a storage space in which a cord is wound around a central axis. The storage space includes a first storage space which is provided to allow the cord to be wound in one row, in a predetermined direction intersecting a direction of the central axis, and has a first height in a direction perpendicular to the predetermined direction that is substantially the same as a diameter of the cord, and a second storage space which is provided on one or both of an outer circumference and an inner circumference of the first storage space, has a second height along the direction of the central axis that is at least twice the diameter of the cord, and is provided to allow the cord to be wound in a plurality of rows along the central axis.

6 Claims, 12 Drawing Sheets

MECHANISM FOR WINDING CORD

1. TECHNICAL FIELD

The present disclosure relates to a mechanism for winding a cord.

2. BACKGROUND ART

JP-T-2001-513979 discloses an apparatus for accommodating or storing a cable having a plurality of conducting wires. The apparatus is provided with a winding drum that can rotate around an axis to accommodate the cable. A lead wire of the cable is connected to a first connecting device and is connected to a wiring of a supply system via the first connecting device in an electrically conductive state. The first connecting device is connected to the winding drum and has a first electrical contact, and the first electrical contact is connected to the lead wire of the cable and is disposed on a circle coaxial with the axis of the drum. The electrical wiring guided to the supply system is connected to a second connecting device, which is axially movable along the axis of the drum and has a second electrical contact, and the second electrical contact forms an electrically conductive state with the first electrical contact.

SUMMARY OF THE INVENTION

The present disclosure provides a mechanism for winding a cord that enables compact and efficient cord storage.

According to the present disclosure, there is provided a mechanism for winding a cord including a storage space in which a cord is wound around a central axis, in which the storage space includes a first storage space which is provided to allow the cord to be wound in one row in a predetermined direction intersecting a direction of the central axis, and has a first height in a direction perpendicular to the predetermined direction that is substantially the same as a diameter of the cord, and a second storage space which is provided on one or both of an outer circumference and an inner circumference of the first storage space, and has a second height along the direction of the central axis at least twice the diameter of the cord, and is provided to allow the cord to be wound in a plurality of rows along the central axis.

According to the present disclosure, it is possible to enable compact and efficient cord storage.

DETAILED DESCRIPTION OF THE EXEMPLARY EMBODIMENT

Background to the Present Disclosure

In a cord reel in the related art, since the cord is wound irregularly in a storage space, a gap is generated between the cords when the cord is wound, and thus an extra space than the volume of the cord to be stored is required. This is a factor that hinders the miniaturization of the cord reel or causes a cord clogging. On the other hand, as disclosed in JP-T-2001-513979, there is also a winding mechanism in which the cord is wound so as to be aligned in one row, and the size is reduced without providing an extra space. However, since a radius at the beginning of winding becomes small, a length of the cord that can be wound within a predetermined number of rotations becomes short, and products that can be used are limited, resulting in lack of versatility.

Therefore, in the following embodiment, an example of a mechanism for winding a cord that enables compact and efficient cord storage will be described.

Hereinafter, embodiments in which the mechanism for winding a cord according to the present disclosure is specifically disclosed will be described in detail with reference to the drawings as appropriate. However, more detailed description than necessary may be omitted. For example, detailed description of already well-known matters and duplicate explanations for substantially the same configuration may be omitted. This is to avoid unnecessary redundancy of the following description and to facilitate the understanding of those skilled in the art. Note that the accompanying drawings and the following description are provided for those skilled in the art to fully understand the present disclosure, and are not intended to limit the subject matter described in the claims.

First Embodiment

Figure 1:
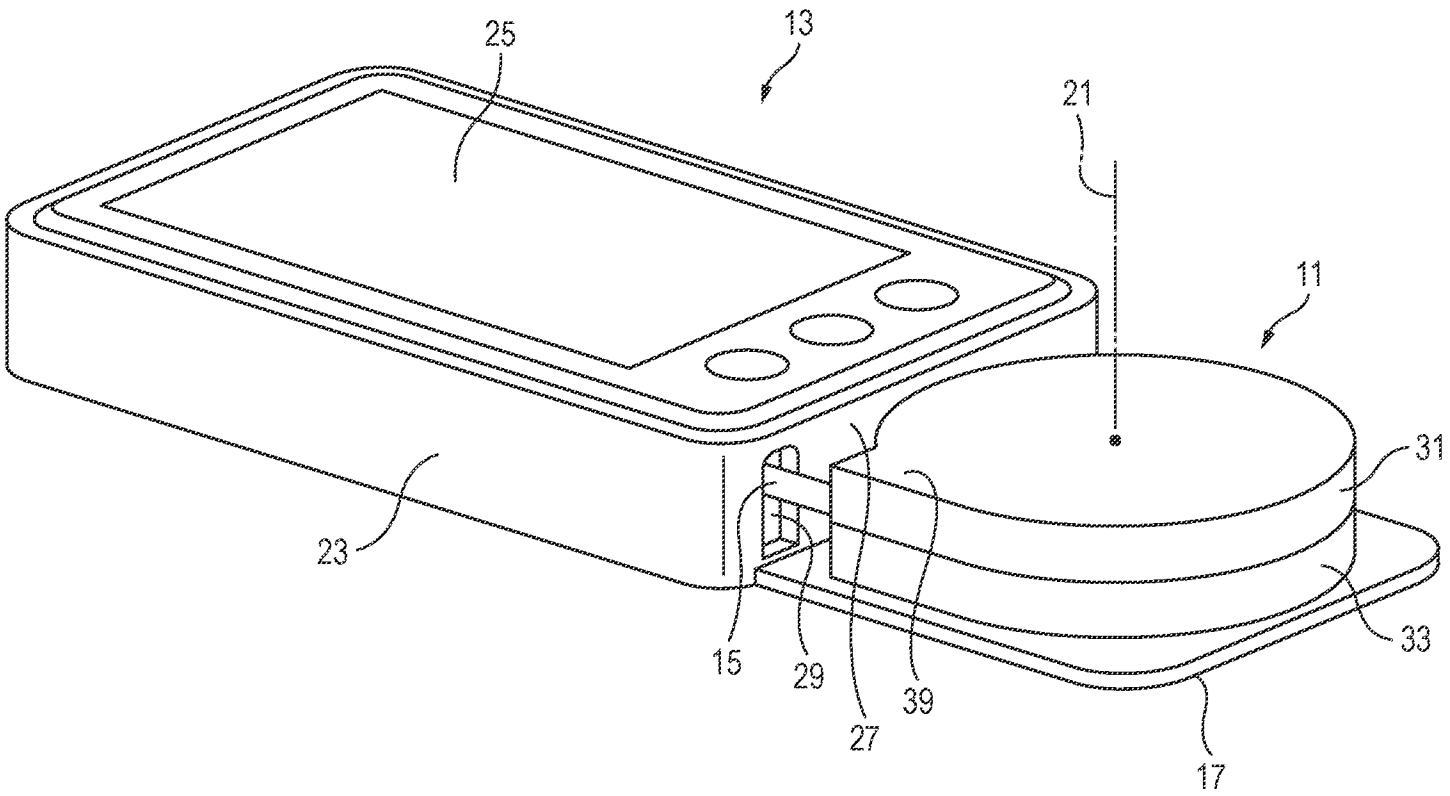
FIG. 1 is a perspective view illustrating an appearance of a handset device incorporating a cord reel having a mechanism for winding a cord according to a first embodiment.

FIG. 1 is a perspective view illustrating an appearance of a handset device 13 incorporating a cord reel 11 having a mechanism for winding a cord according to a first embodiment. The cord reel 11 having the mechanism for winding a cord according to the first embodiment is used by being incorporated in, for example, the handset device 13. The mechanism for winding a cord may be used for other devices for inserting and removing a cord 15.

In the handset device 13, the cord reel 11 is fixed to the upper surface on one end side of a base 17 having a rectangular shape in a plan view. In the present specification, "lower" means the side on which the base 17 is located, and "upper" means the side on which the cord reel 11 is located with respect to the base 17.

In the cord reel 11, the central axis 21 of the reel 19 (refer to FIG. 3) is fixed in a direction perpendicular to the base 17. A cradle 23 as a pedestal formed in a square frame is integrally fixed to the upper surface on the other end side of the base 17. Inside the cradle 23, a handset 25 formed of a flat rectangular parallelepiped is detachably accommodated. The handset 25 may also function, for example, as a controller for a display device having a touch panel function. In the cradle 23, a cord through hole 29 is formed in a side wall 27 facing the cord reel 11. The cord 15 drawn from the cord reel 11 is passed through the cord through hole 29. The cord 15 passed through the cord through hole 29 is inserted into a housing of the handset 25 mounted on the cradle 23 and electrically connected to a circuit such as a control board or an electronic component.

The handset device 13 is attached so that only the handset 25 is exposed, for example, on a back surface of a backrest of a front seat located in front of a seat in an aircraft, or on an inner surface of an armrest portion provided on a side portion of the seat. In the handset device 13, the cord 15 is pulled out from the cord reel 11 when the user takes out the handset 25. The pulled out cord 15 is locked so as not to be pulled in. Further, when the handset 25 is returned to the cradle 23, when the lock is released, the cord 15 is automatically wound around the cord reel 11. The lock may be released by pulling out the cord 15 or by pressing a release button or the like by the user.

Figure 2:
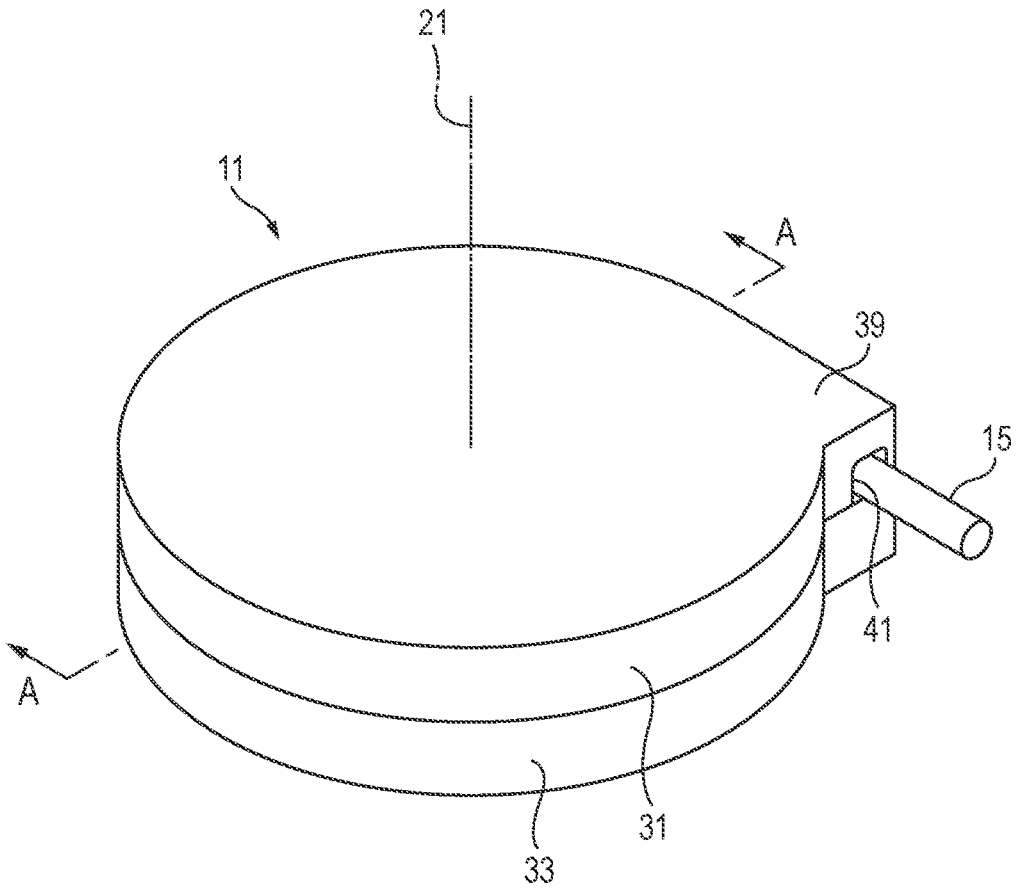
FIG. 2 is a perspective view of the cord reel illustrated in FIG. 1.

FIG. 2 is a perspective view of the cord reel 11 illustrated in FIG. 1. In the cord reel 11, an upper case 31 and a lower case 33, which are flat cylindrical and have a bottom wall, are integrally assembled by aligning the opening side from the top and bottom. A reel accommodating space 35 (refer to FIG. 3) is formed between the assembled upper case 31 and the lower case 33. The reel 19 is rotatably accommodated in the reel accommodating space 35 with the central axis 21 as the center of rotation. The central axis 21 refers to the axis of a reel shaft 37 (refer to FIG. 3).

The upper case 31 and the lower case 33 are formed with a cord entry and exit portion 39 that swells in the tangential direction of the circumference of the cylinder. For example, the cord entry and exit 41 opens to the cord entry and exit portion 39 of the upper case 31. The cord 15 wound around the reel 19 is taken in and out from the cord entry and exit 41. The cord 15 pulled out from the cord entrance 41 is passed through the cord through hole 29 of the cradle 23.

Figure 3:
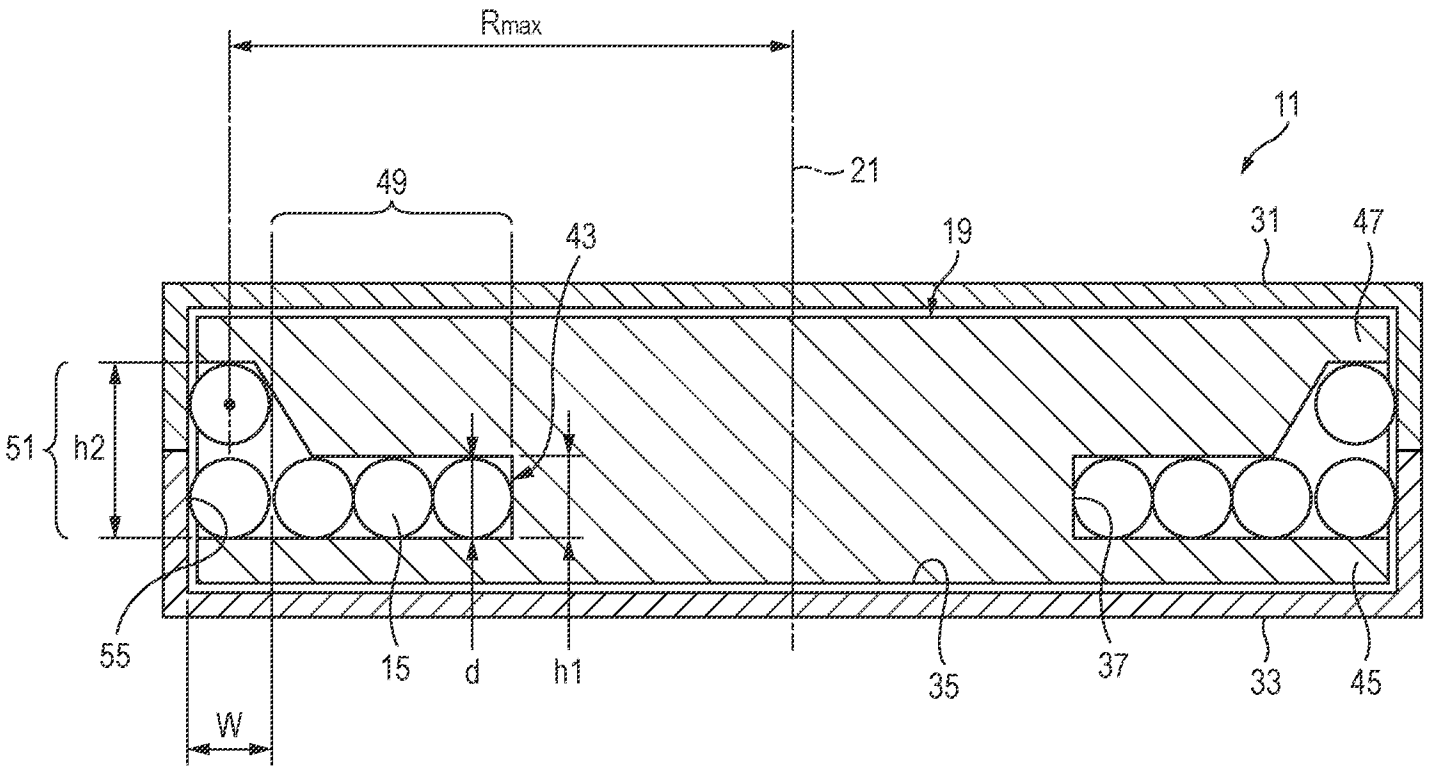
FIG. 3 is a cross-sectional view taken along line A-A of FIG. 2.

FIG. 3 is a cross-sectional view taken along line A-A of FIG. 2. The mechanism for winding a cord has a central axis 21 and a storage space 43 in which the cord 15 is wound around the central axis 21. At both ends of the reel shaft 37 having the central axis 21, a lower flange portion 45 and an upper flange portion 47, which have a disc-shape and project outward in a radial direction about the central axis 21, are integrally formed. The reel 19 is formed of the reel shaft 37, the lower flange portion 45, and the upper flange portion 47. The storage space 43 is formed so as to be recessed inward in the radial direction from the outer peripheral surface of the reel 19.

The storage space 43 includes a first storage space 49 and a second storage space 51.

In the first storage space 49, the cord 15 is provided to be in a row, when being wound around the reel 19, in a predetermined direction (refer to below) which is a direction intersecting the direction of the central axis 21.

In the first embodiment, the predetermined direction is a direction perpendicular to the direction of the central axis 21. The first storage space 49 has a height h1 in a direction perpendicular to a predetermined direction which is substantially the same as a diameter d of the cord 15. Therefore, as illustrated in FIG. 3, in the first storage space 49, the cord 15 wound around the outer circumference of the reel shaft 37 a plurality of times is aligned in a row in the direction perpendicular to the central axis 21 without being shafted in the direction along the central axis 21.

Figure 4:
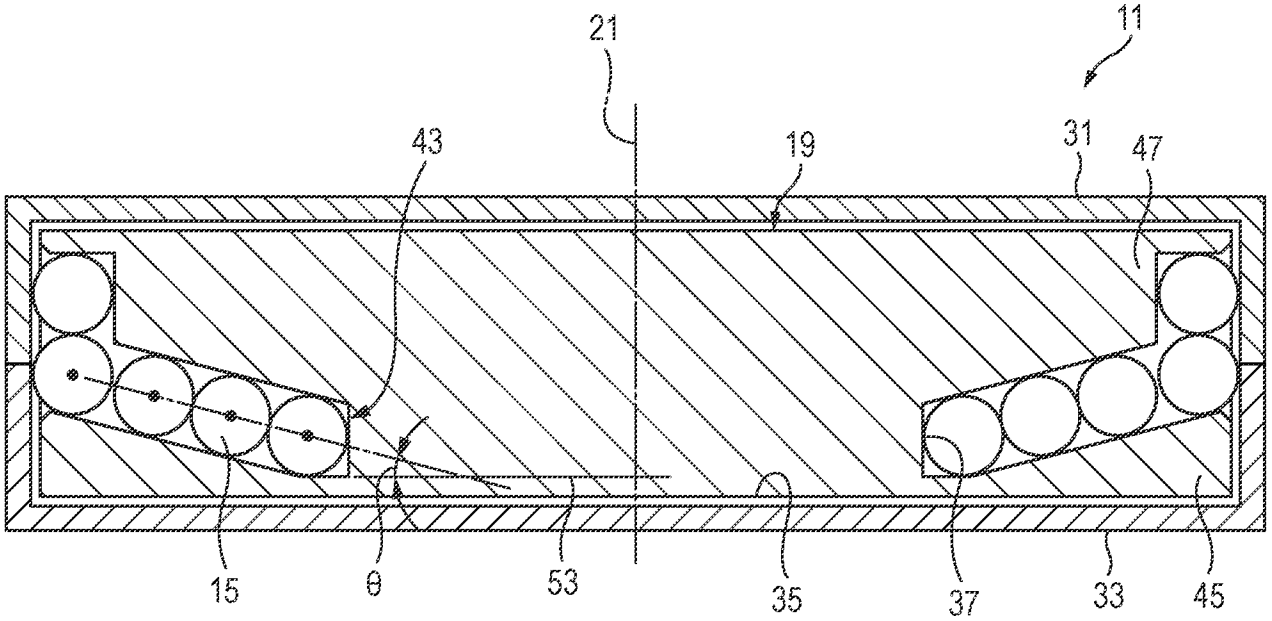
FIG. 4 is a cross-sectional view of a cord reel according to a first modification of the first embodiment, in which a first storage space is inclined.

FIG. 4 is a cross-sectional view of a cord reel 11 according to a first modification of the first embodiment, in which the first storage space 49 is inclined. The direction of the first storage space 49 that intersects the direction of the central axis 21 does not have to be limited to the direction perpendicular to the central axis 21. For example, as illustrated in FIG. 4, the first storage space 49 may be formed so as to have an angle θ (acute angle) with respect to a virtual line 53 perpendicular to the central axis 21. By forming the first storage space 49 in an inclined manner, in the reels 19 having the same height, it is possible to secure a large length in the row direction in which the cord 15 is aligned as compared with the first storage space 49 perpendicular to the central axis 21.

As illustrated in FIGS. 3 and 4, a second storage space 51 is provided on, for example, the outer periphery of the first storage space 49. As illustrated in FIG. 3, for example, the second storage space 51 has a height h2 in the direction along the central axis 21 which is at least twice the diameter d of the cord 15. That is, in the second storage space 51, the cord 15 is provided to be in a plurality of rows in the direction along the central axis 21 when the cord 15 is wound. FIGS. 3 and 4 illustrate an example in which the cord 15 is accommodated in two rows in the second storage space 51. The number of rows of the cord 15 accommodated in the second storage space 51 may be three or more.

As illustrated in FIG. 3, a width w of the second storage space 51 in the direction perpendicular to the central axis 21 is substantially the same as the diameter d of the cord 15. The width w of the second storage space 51 is a distance between the cord 15 on the outermost diameter side accommodated in the first storage space 49 and an inner wall surface 55 of the upper case 31 and the lower case 33. Therefore, in the second storage space 51, the cord 15 is wound in a plurality of rows while being shafted by one row in the direction along the central axis 21 without overlapping in the radial direction of the reel 19. That is, in the second storage space 51, the cord 15 is spirally wound around the outer circumference of the reel 19.

In the mechanism for winding a cord, the cord 15 is aligned in an L shape illustrated in FIG. 3, for example, in the cross section of the storage space 43 including the central axis 21 taken along the central axis 21. The L-shape means that a plurality of cords 15 are arranged in a row in a direction intersecting the central axis 21 in the first storage space 49, and a plurality of cords 15 are arranged in a plurality of rows in a direction along the central axis 21 in the second storage space 51. In the second storage space 51, the first row is wound side by side in the direction intersecting the central axis 21 on the outside of the cord 15 wound around the outermost circumference of the first storage space 49. In the second storage space 51, the cord 15 in the second row moves from a track in the circumferential direction of the first row to a track in the second row shifted in the direction along the central axis 21 by substantially the diameter d of the cord 15. As a result, in the second storage space 51, the cord 15 is sequentially wound around the outer circumference of the reel 19 in a spiral direction along the central axis 21.

Figure 5:
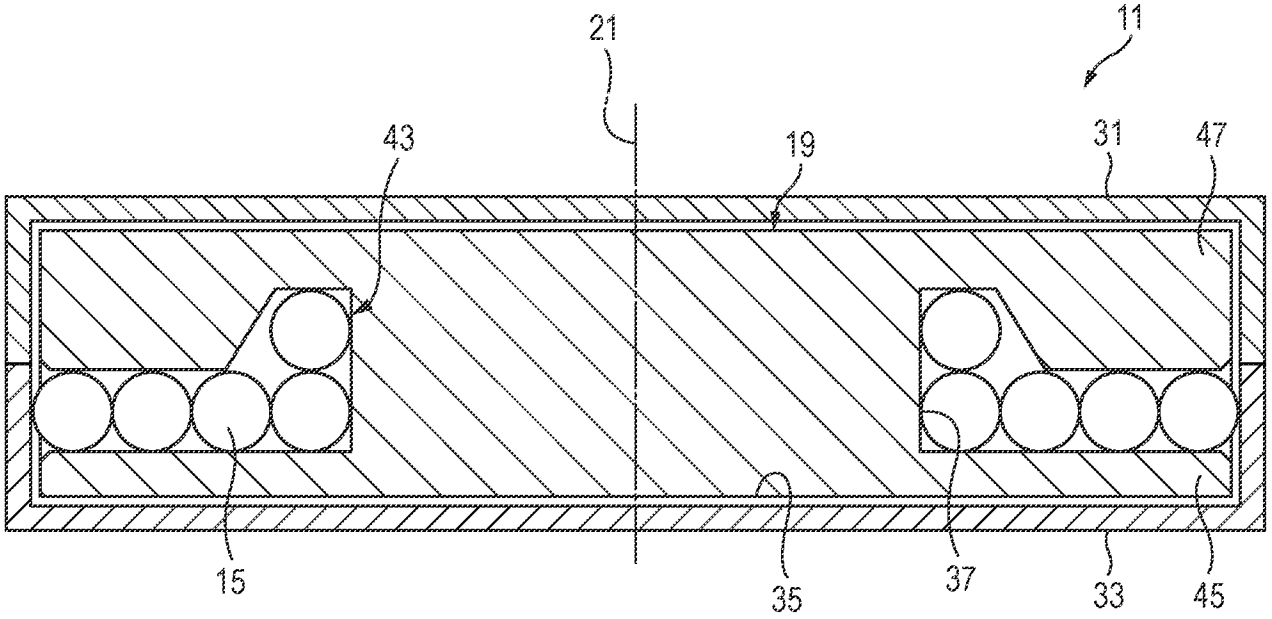
FIG. 5 is a cross-sectional view of a cord reel according to a second modification of the first embodiment, in which a second storage space is provided on an inner circumference of the first storage space.

FIG. 5 is a cross-sectional view of the cord reel 11 according to a second modification of the first embodiment, in which a second storage space 51 is provided on an inner circumference of the first storage space 49. As illustrated in FIG. 5, for example, the second storage space 51 may be provided on the inner circumference of the first storage space 49, or on both the outer circumference and the inner circumference of the first storage space 49, although not shown.

Next, an operation of the mechanism for winding a cord according to the first embodiment will be described.

The mechanism for winding a cord according to the first embodiment has a central axis 21 and a storage space 43 in which the cord 15 is wound around the central axis 21. The storage space 43 includes the first storage space 49 in which the cord 15 is provided to be in a row, when being wound, in a predetermined direction which is a direction intersecting a direction of the central axis 21, and the height h1 in the direction perpendicular to the predetermined direction is substantially the same as a diameter of the cord 15, and the second storage space 51 which is provided on an outer circumference, an inner circumference, or both of the first storage space 49 and in which the height h2 in a direction along the central axis 21 is at least twice the diameter of the cord 15, and the cord 15 is provided to be in a plurality of rows in a direction along the central axis 21 when the cord 15 is wound.

In the mechanism for winding a cord according to the first embodiment, when the storage space 43 rotates around the central axis 21 while the cord 15 is pulled out, the cord 15 is wound from the inside in the first storage space 49 in the radial direction of rotation. The first storage space 49 has a height h1 in a direction perpendicular to a predetermined direction which is substantially the same as a diameter d of the cord 15. That is, in the first storage space 49, the cord 15 is wound in a row outward in the radial direction without being shift in the direction perpendicular to the predetermined direction.

In the first storage space 49, the cord 15 is wound in a row outward in the radial direction, so that no extra space is generated. Further, since the cord 15 is not wound irregularly, the cord 15 is not entangled. As a result, in the first storage space 49, the cord is less likely to be clogged, and the cord 15 can be efficiently wound.

The second storage space 51 is provided on the outer circumference, the inner circumference, or both of the first storage space 49. The second storage space 51 has a height h2 in the direction along the central axis 21 which is at least twice the diameter d of the cord 15. As a result, in the second storage space 51, the cord 15 can be wound in a plurality of rows (at least two rows) in the direction along the central axis 21. The cord 15 aligned in the first storage space 49 and wound in one row is wound in a plurality of rows in the second storage space 51 with the cord 15 shifted in the direction along the central axis 21 for each turn. That is, it is spirally wound around the outer circumference of the reel 19. Also in this second storage space 51, the cord 15 is wound in an aligned manner and are is wound irregularly, so that the cord 15 is not entangled. As a result, the second storage space 51 can be less likely to cause cord clogging. In the mechanism for winding a cord, a cord storage amount can be increased without increasing the outer diameter of the storage space 43 by providing the second storage space 51.

As a result, the mechanism for winding a cord enables compact and efficient cord storage while preventing cord clogging. Further, since the cord reel 11 having the mechanism for winding a cord can increase the cord storage amount, the range of target products that can be used is expanded, and the versatility can be enhanced.

Further, in the mechanism for winding a cord, the predetermined direction can be set as a direction perpendicular to the direction of the central axis 21.

In this mechanism for winding a cord, a predetermined direction that intersects the direction of the central axis 21 is a direction perpendicular to the direction of the central axis 21. That is, in the first storage space 49, the cord 15 is wound in a row outward in the radial direction in the direction perpendicular to the central axis 21. As a result, the first storage space 49 can reduce the formation space of the reel 19 in the direction along the central axis 21 as compared with the case where the winding direction of the cord 15 intersects the central axis 21 diagonally. As a result, the cord reel 11 having the first storage space 49 perpendicular to the central axis 21 can have a smaller height (thickness) in the direction along the central axis 21, and the built-in space becomes shallower, and thereby the versatility can be further improved.

Further, in the first storage space 49 in which the cord 15 is wound in a row in the direction perpendicular to the central axis 21, in the vicinity of the cord entry and exit 41, the cord 15 can be pulled out and wound in the direction along the tangent line of the outermost circle of the wound cord 15 almost without bending of the cord 15. As a result, the mechanism for winding a cord can realize the cord reel 11 in which the cord 15 can be smoothly taken in and out.

The cord 15 can be pulled out and wound in the direction along the tangent line of the outermost circle of the wound cord 15 almost without bending of the cord 15, a width w of the second storage space 51 in the direction perpendicular to the central axis 21 is substantially the same as the diameter d of the cord 15.

In this mechanism for winding a cord, only one cord 15 is aligned in the second storage space 51 in the direction perpendicular to the central axis 21. That is, the cord 15 is not wound so as to overlap in the direction perpendicular to the central axis 21. As a result, in the second storage space 51, the cord 15 is less likely to be entangled due to being wound in an irregular manner, and the cord 15 can be smoothly taken in and out.

Further, in the mechanism for winding a cord, the cord 15 may be aligned in an L shape, in the cross section of the storage space 43 including the central axis 21 taken along the central axis 21.

In the mechanism for winding a cord, the cord 15 is aligned in an L shape, in the cross section of the storage space 43. In the L-shaped storage space 43, the first row of the second storage space 51 is wound side by side in the direction intersecting the central axis 21 on the outside of the cord 15 wound around the outermost circumference of the first storage space 49. That is, the cord 15 in the first row of the second storage space 51 is aligned on the extension of the cord rows arranged in the first storage space 49. In the second storage space 51, the cord 15 in the second row moves from a track in the circumferential direction of the first row to a track in the second row shifted in the direction along the central axis 21 by substantially the diameter d of the cord 15. As a result, in the second storage space 51, the cord 15 is sequentially wound around in a spiral direction along the central axis 21.

In the L-shaped storage space 43, the second storage space 51 may be provided on the winding start side, the winding end side, or both the winding start side and the winding end side of the first storage space 49.

In the storage space 43 in which the second storage space 51 is provided on the winding start side of the first storage space 49, the winding end of the cord 15 is the outermost circumference of the first storage space 49 wound in one row. In this case, when the cord 15 is pulled out and stored, the cord 15 can be pulled out and wound in the direction along the tangent line of the outermost circle of the wound cord 15 almost without bending of the cord 15. As a result, the mechanism for winding a cord can realize the cord reel 11 in which the cord 15 can be smoothly pulled out and wound.

In the storage space 43 in which the second storage space 51 is provided on the winding end side of the first storage space 49, the winding length of the cord 15 can be increased by the circumferential length when the winding radius of the second storage space 51 is the maximum winding radius Rmax as illustrated in FIG. 3. Therefore, in the storage space 43 in which the second storage space 51 is provided on the winding end side of the first storage space 49, the length of the cord 15 that can be wound within a predetermined number of rotations can be increased as compared with the storage space 43 in which the second storage space 51 is provided on the winding start side of the first storage space 49.

Second Embodiment

Figure 6:
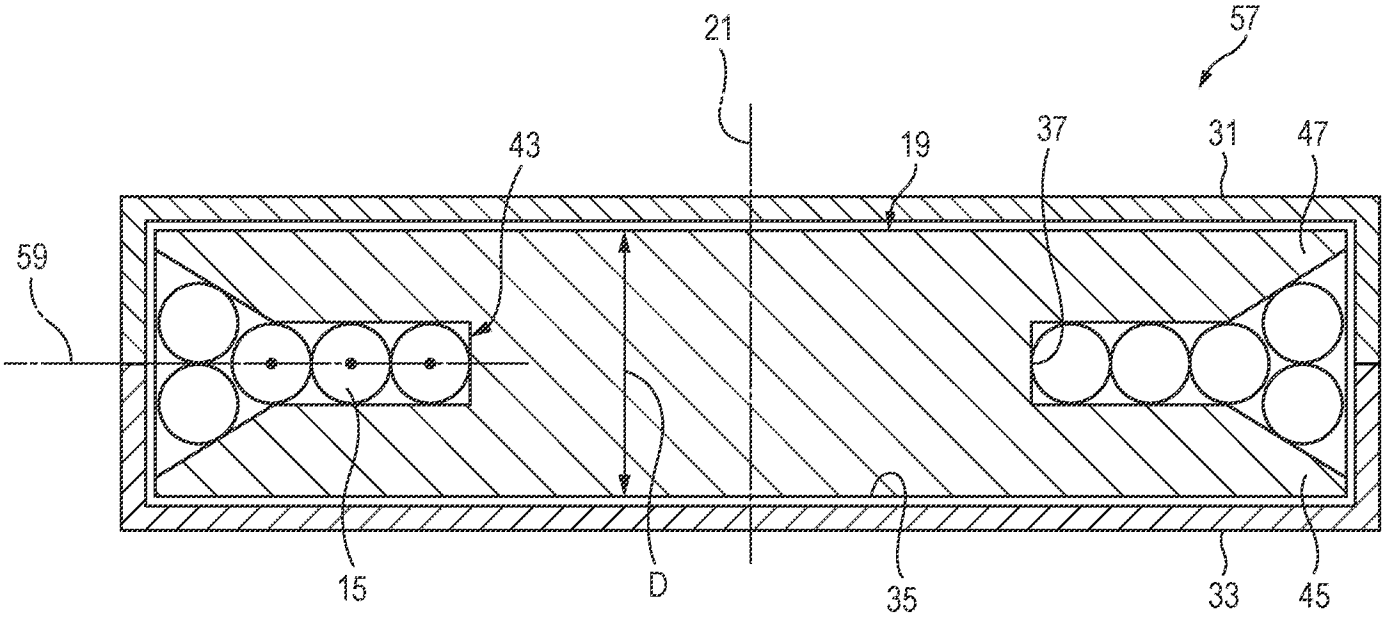
FIG. 6 is a cross-sectional view of a cord reel according to a second embodiment including a T-shaped storage space.

Next, the second embodiment will be described. FIG. 6 is a cross-sectional view of a cord reel 57 according to a second embodiment including a T-shaped storage space 43. In the second embodiment, the same members and parts as those illustrated in the first embodiment are designated by the same reference numerals, and duplicate description will be omitted.

In the mechanism for winding a cord according to the second embodiment, the cord 15 is aligned in a T shape, for example, in the cross section of the storage space 43 including the central axis 21 taken along the central axis 21. The T-shape means a form in which a plurality of cords 15 are arranged in a row in the first storage space 49, and a plurality of cords 15 are line-symmetrically arranged at a center line 59 as a boundary passing through the center of the plurality of cords 15 arranged in a row in the first storage space 49 in the second storage space 51.

In the case of the T-shaped storage space 43, the second storage space 51 is provided on the winding end side of the first storage space 49.

In the T-shaped storage space 43, between the first storage space 49 and the second storage space 51, the track is transitioned from the cord 15 wound around one of the storage spaces 43 to the other storage space 43 at a part in the circumferential direction.

Next, an operation of the mechanism for winding a cord according to the second embodiment will be described.

In the mechanism for winding a cord according to the second embodiment, the cord 15 may be aligned in a T shape, for example, in the cross section of the storage space 43 including the central axis 21 taken along the central axis 21.

In this mechanism for winding a cord, since the second storage space 51 is provided on the winding end side of the first storage space 49, the winding length of the cord 15 can be increased by the circumference length on the cord winding end side that maximizes the winding radius. Therefore, in the T-shaped storage space 43, the length of the cord 15 that can be wound within a predetermined number of rotations can be increased.

Further, in the T-shaped storage space 43, in the second storage space 51, a plurality of cords 15 can be arranged line-symmetrically at the center line 59 of the first storage space 49 as a boundary, as compared to the L-shaped storage space 43 in which the cord 15 is wound on only one side at the center line 59 as a boundary, the outer peripheral surface of the reel 19 can be used more efficiently. In this case, in the T-shaped storage space 43, since the first storage space 49 can be arranged at the center position (D/2) of the reel 19 in the thickness direction D, the mass of the reel 19 is not biased to one side in the direction along the central axis 21, and the reel 19 can be rotated smoothly.

Third Embodiment

Figure 7:
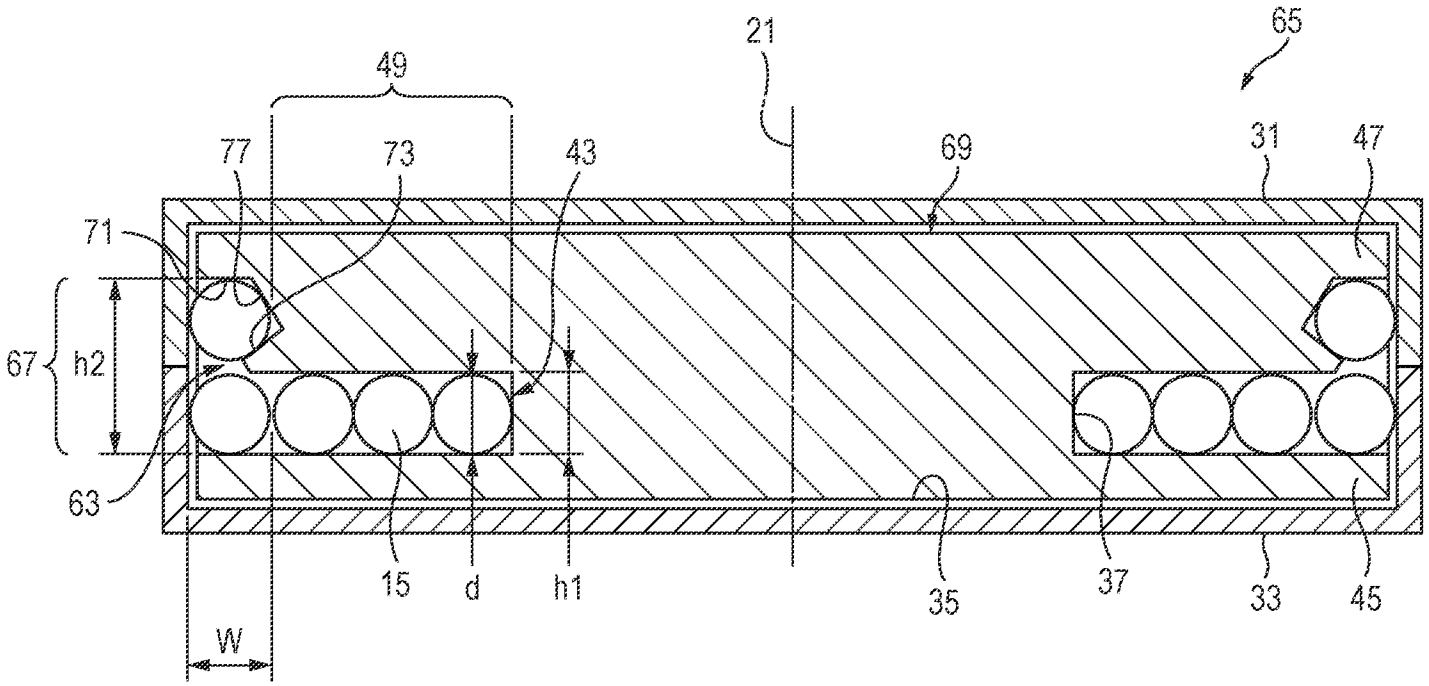
FIG. 7 is a cross-sectional view of a cord reel according to a third embodiment including a guide having a slit formed therein.

Next, the third embodiment will be described. FIG. 7 is a cross-sectional view of the cord reel 65 according to the third embodiment including a guide 63 in which a slit 61 is formed. In the third embodiment, the same members and parts as those illustrated in the first embodiment are designated by the same reference numerals, and duplicate description will be omitted.

The mechanism for winding a cord according to the third embodiment further includes the guide 63 for aligning the cord 15 in the second storage space. The cord 15 of the second storage space 67 is aligned and wound along the central axis 21 by the guide 63.

Figure 8:
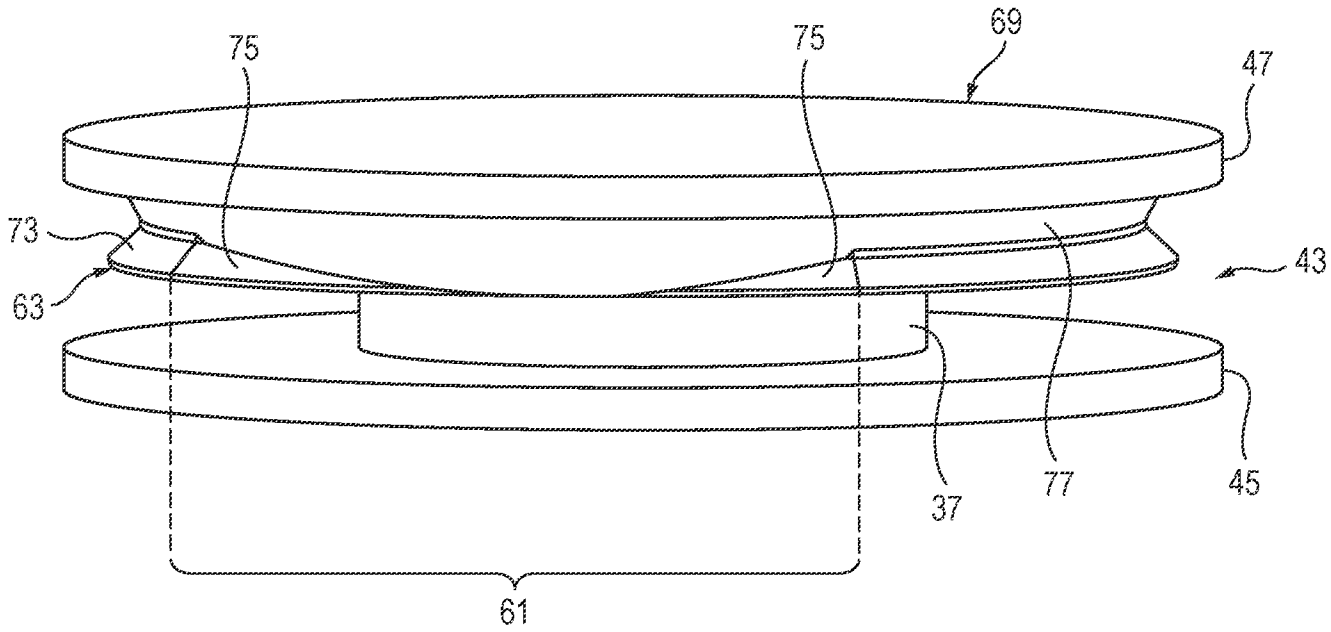
FIG. 8 is a perspective view of the reel illustrated in FIG. 7.

FIG. 8 is a perspective view of a reel 69 illustrated in FIG. 7. The guide 63 projects outward in the radial direction about the central axis 21 and extends in the circumferential direction. The guide 63 is formed so that the thickness gradually decreases in the projecting direction. Therefore, the cord 15 wound between the upper flange portion 47 and the guide 63 is sandwiched between the vertical side surface 71 of the upper flange portion 47 (refer to FIG. 7) and the inclined side surface 73 of the guide 63. As a result, in the second storage space 67, the cord 15 in the first row and the cord 15 in the second row are aligned in the direction along the central axis 21 with a certain interval.

A part of the guide 63 in the circumferential direction is cut out by the slit 61 through which the cord 15 can pass. The slit 61 is formed shorter than the circumferential length of the guide 63. The slit 61 has a track switching portion 75 formed so that the projecting height of the guide 63 is gradually lowered on the start end side and the finish end side of the slit 61. By providing the track switching portion 75 in the slit 61, in the second storage space 67, it possible to smoothly transition the track when the cord 15 is wound and pulled out by shifting in the direction along the central axis 21.

Figure 9:
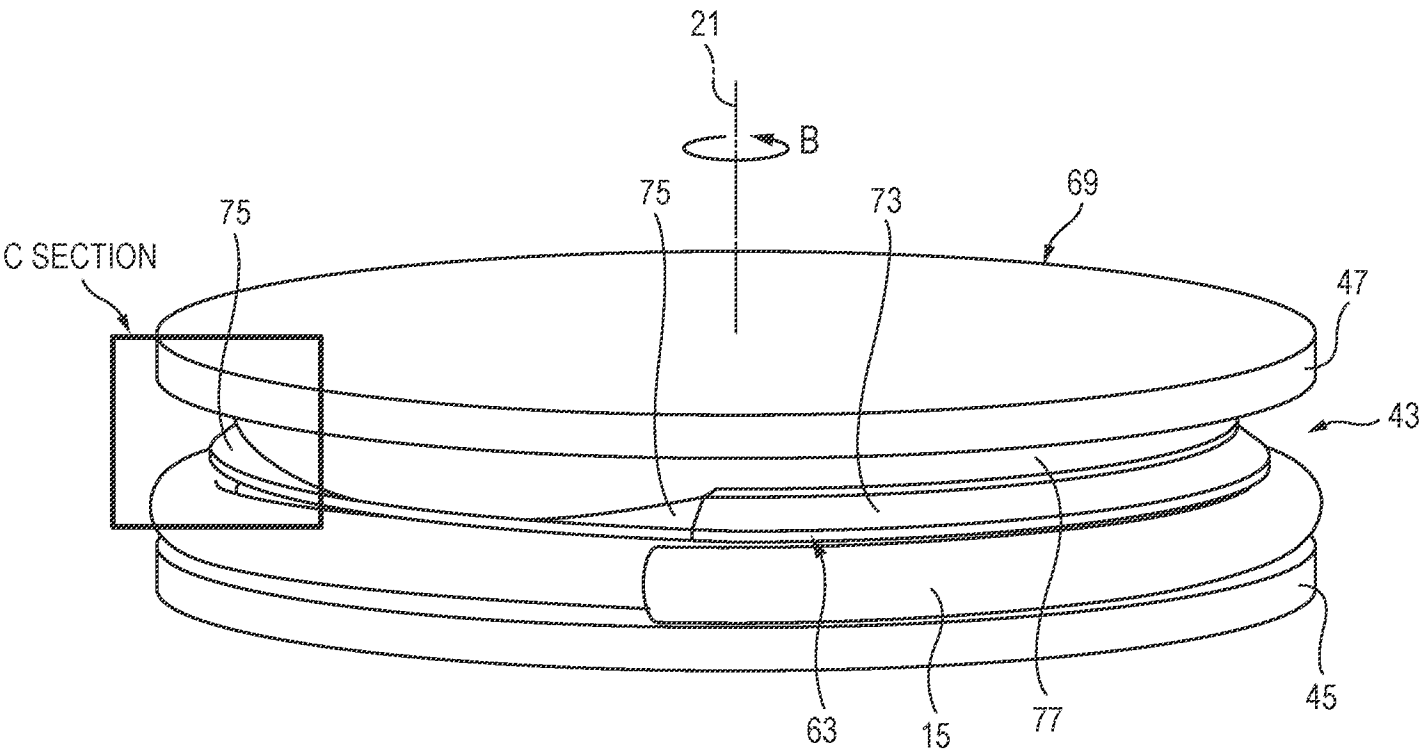
FIG. 9 is a perspective view of a reel around which the cord on a fourth lap is wound.

FIG. 9 is a perspective view of the reel 69 around which the cord 15 on a fourth lap is wound. In the second storage space 67 provided with the slit 61, when the reel 19 rotates in a B direction of FIG. 9, the cord 15 wound around the fourth lap reaches the slit 61.

Figure 10:
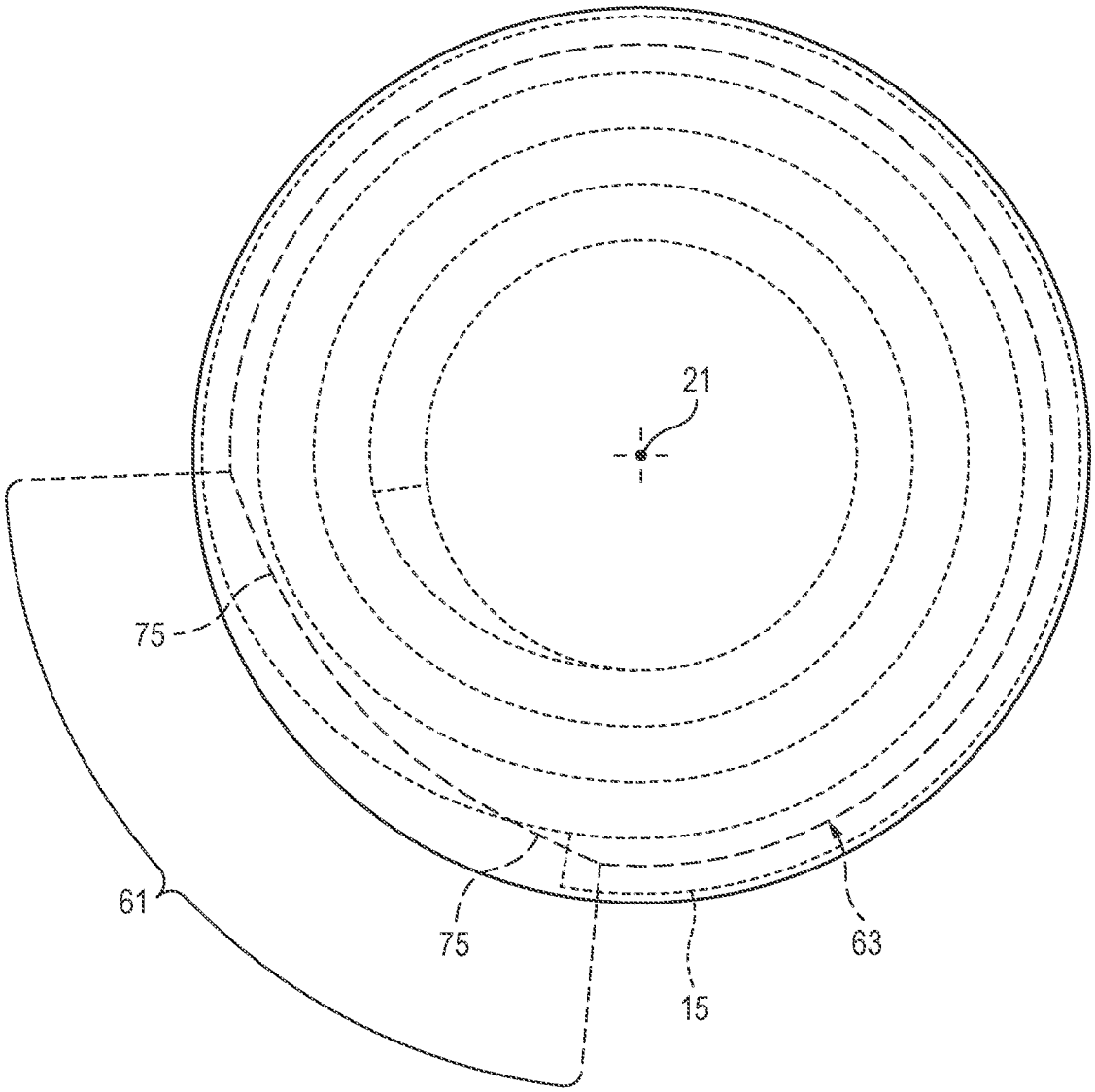
FIG. 10 is a plan view of an upper flange portion of the reel around which the cord on the fourth lap is wound.

FIG. 10 is a plan view of an upper flange portion 47 of the reel 69 around which the cord 15 on the fourth lap is wound. The slit 61 is gradually lowered in the direction in which the cord 15 on the fourth lap is further wound. More specifically, the slit 61 is formed with a length of approximately ¼ of the circumferential length of the fourth circumference. The end of the slit 61 in the direction in which the cord 15 is wound becomes the track switching portion 75, and the slit 61 is gradually formed higher again. The track of the cord 15 is transitioned to the second row of the second storage space 67 at the position of the slit 61 where the guide 63 is the lowest. That is, the cord 15 is spirally wound.

Figure 11:
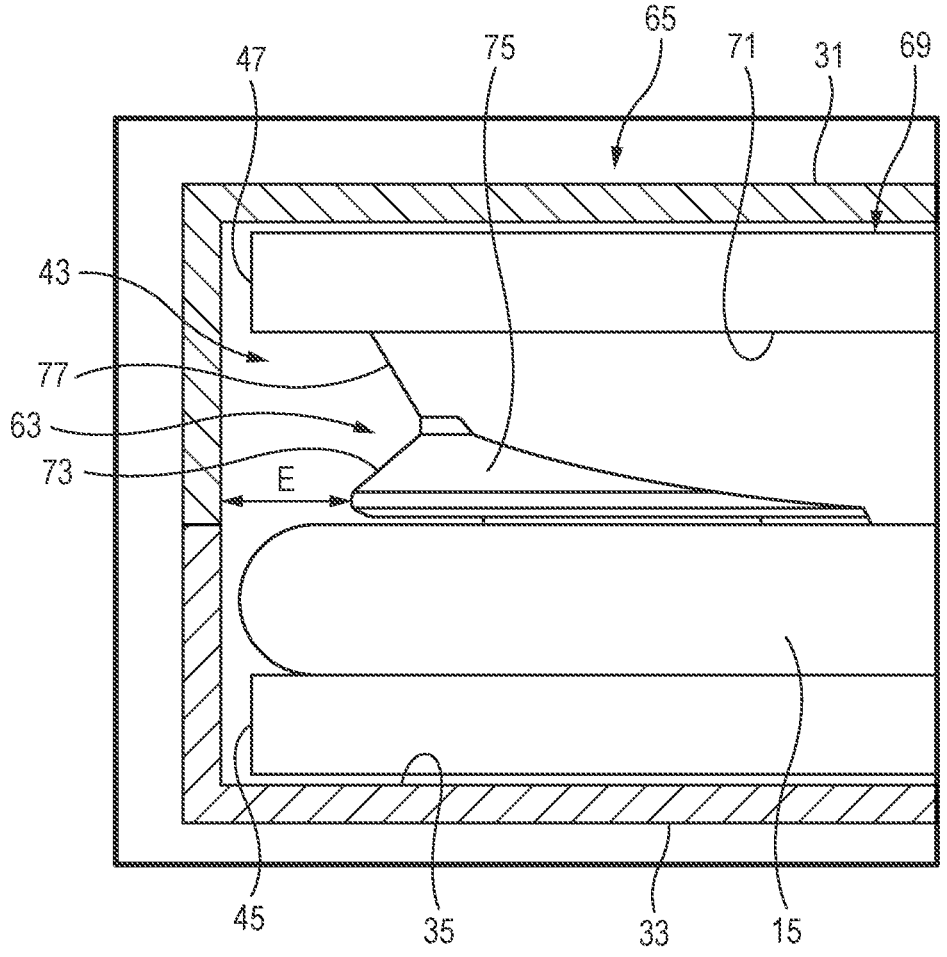
FIG. 11 is an enlarged front view of a main part for explaining a part C of FIG. 9.

FIG. 11 is an enlarged front view of a main part for explaining a part C of FIG. 9. In the second storage space 67, a distance E between a protruding tip of the guide 63 and the inner wall surface 55 of the upper case 31, for example, is set to a size that the cord 15 cannot pass through. The outer peripheral surface of the reel 19 connected to the vertical side surface 71 of the upper flange portion 47 is formed by a tapered surface 77 that approaches the central axis 21 as it separates from the vertical side surface 71. The cord 15 wound in the second row is positioned so that three points in the circumferential direction are in contact with the vertical side surface 71, the tapered surface 77, and the inclined side surface 73.

Figure 12:
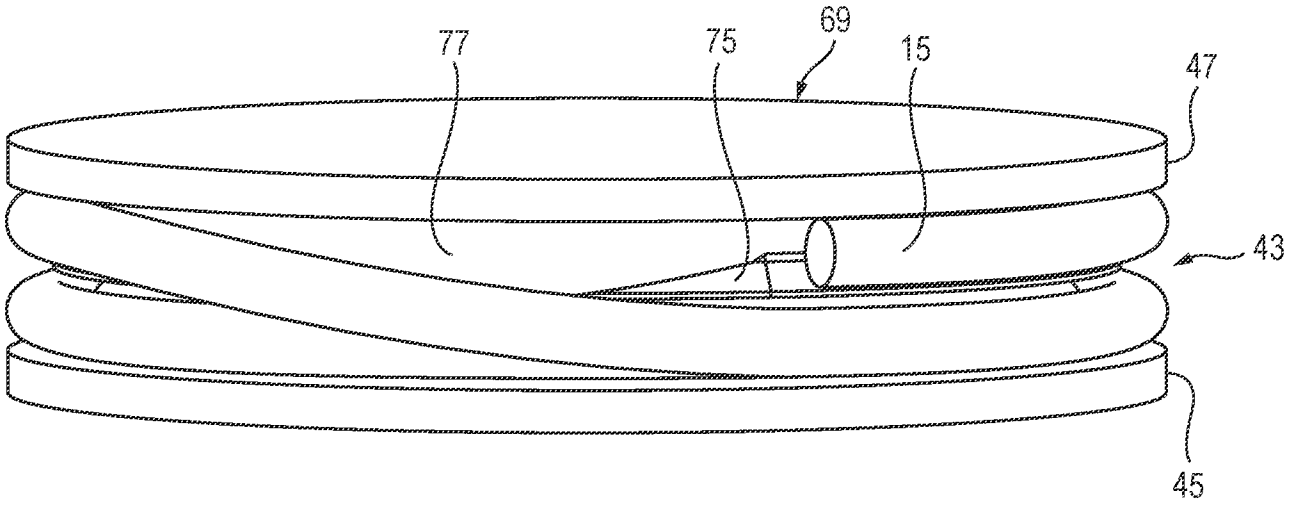
FIG. 12 is a perspective view of a reel around which the cord on a fifth lap is wound.

FIG. 12 is a perspective view of the reel 69 around which the cord 15 on a fifth lap is wound. As a result, the cord 15 whose track has transitioned to the second row of the second storage space 67 is wound around the outer circumference of the reel 19 by shifting in the direction along the central axis 21 without coming into contact with the cord 15 in the first row.

In the above description, the cord 15 is wound around the first storage space 49 three times, and the cord 15 on the fourth and fifth laps is wound around the second storage space 67; however, this is an example, and the number of windings may be appropriately set, for example, the cord 15 is wound around the first storage space 49 five times, and the cord 15 on the sixth and seventh laps is wound around the second storage space 67.

Next, an operation of the mechanism for winding a cord according to the third embodiment will be described.

The mechanism for winding a cord according to the third embodiment further includes the guide 63 for aligning the cord 15 in the second storage space.

In this mechanism for winding a cord, in the second storage space 51, the cord 15 wound in the direction along the central axis 21 is aligned by the guide 63. That is, the cords 15 wound in the direction along the central axis 21 are arranged adjacent to each other with the guide 63 switched therebetween. As a result, the cords 15 wound around the second storage space 51 are prevented from being too far apart from each other or being too close to each other, and can be smoothly taken in and out of the cord reel 11.

Further, in the mechanism for winding a cord, the guide 63 projects outward in the radial direction with the central axis 21 as the center and extends in the circumferential direction, and a part in the circumferential direction is cut out by the slit 61 through which the cord 15 can pass.

In this mechanism for winding a cord, the guide 63 is provided with a slit 61 through which the cord 15 can pass. The slit 61 is formed by cutting out a part of the guide 63 that projects outward in the radial direction of the reel 19 and extends in the circumferential direction.

For example, in the storage space 43 provided with the second storage space 51 on the outer circumference of the first storage space 49, the height h2 of the second storage space 51 in the direction along the central axis 21 is at least twice as high as the diameter d of the cord 15. In the L-shaped storage space 43, when the cord 15 is wound, the cord 15 is wound in, for example, two rows in the direction along the central axis 21.

The guide 63 is provided to extend in the circumferential direction between the cords 15 wound in the two rows in the second storage space 51. The slit 61 enables a transition from the first row to the second row and a transition from the second row to the first row of the track around which the cord 15 is wound by cutting out a part of the guide 63 in the circumferential direction.

For example, in the storage space 43 in which the cord 15 on the third lap is wound in one row in the direction perpendicular to the central axis 21 in the first storage space 49, and the cord 15 is wound in the two rows in the direction along the central axis 21 in the second storage space 51, the cord 15 is wound five times in total. In this case, the cord 15 in the first row wound in the second storage space 51 corresponds to the cord 15 in the fourth lap wound outside the cord 15 having the outermost diameter wound in one row in the first storage space 49. The cord 15 in the second row wound in the second storage space 51 is the cord 15 in the fifth lap wound with the guide 63 sandwiched with respect to the cord 15 in the first row.

In the L-shaped storage space 43, when the cord 15 is wound on the fourth lap in the second storage space 51, the slit 61 of the guide 63 that aligns the cord 15 on the fourth lap becomes the cord on the fifth lap is rotated and arrives immediately before the winding start position of the cord 15 on the fifth lap. Here, the cord 15 is not further wound outward in the radial direction of the fourth lap, and by passing through the slit 61, the track is transitioned from the first row to the second row, and the cord on the fifth lap is wound as the second row in the second storage space.

In this mechanism for winding a cord, by providing the guide 63 provided with the slit 61, the tracks of the cord 15 wound in a plurality of rows in the second storage space 51 are transitioned, and the cord 15 can be smoothly and surely wound and pulled out from the direction intersecting the central axis 21 to the direction along the central axis 21.

Therefore, according to the mechanism for winding a cord according to the first, second, and third embodiments, it is possible to enable compact and efficient cord storage while preventing cord clogging.

Although various embodiments have been described with reference to the drawings, it goes without saying that the present disclosure is not limited to such examples. It is clear that a person skilled in the art can come up with various modifications, revisions, substitutions, additions, deletions, and equality within the scope of the claims, and it is understood that those also belong to the technical scope of the present disclosure. Further, the respective constituent elements in the various embodiments described above may be optionally combined without departing from the spirit of the invention.

The present disclosure is useful as a mechanism for winding a cord that enables compact and efficient cord storage while preventing cord clogging.

What is claimed is:

1. A mechanism for winding a cord comprising:

a storage space in which a cord is wound around a central axis, wherein the storage space includes a first storage space which is provided to allow the cord to be wound in one row in a predetermined direction intersecting a direction of the central axis, and the first storage space having a first height in a direction perpendicular to the predetermined direction, the first height being substantially the same as a diameter of the cord, and a second storage space which is provided on one or both of an outer circumference and an inner circumference of the first storage space and has a second height along the direction of the central axis, the second height being at least twice the diameter of the cord, the second storage space being provided to allow the cord to be wound in a plurality of rows along the central axis, wherein the second storage space has a second width in a direction perpendicular to the central axis, the second width being substantially the same as the diameter of the cord.

2. The mechanism for winding a cord according to claim 1, wherein the predetermined direction is perpendicular to the direction of the central axis.

3. The mechanism for winding a cord according to claim 1, wherein the cord is arranged in an L shape in a cross section of the storage space including the central axis and taken along the central axis.

4. The mechanism for winding a cord according to claim 1, wherein the cord is arranged in a T shape in a cross section of the storage space including the central axis and taken along the central axis.

5. A mechanism for winding a cord comprising:

a storage space in which a cord is wound around a central axis, wherein the storage space includes a first storage space which is provided to allow the cord to be wound in one row in a predetermined direction intersecting a direction of the central axis, and the first storage space having a first height in a direction perpendicular to the predetermined direction, the first height being substantially the same as a diameter of the cord, and a second storage space which is provided on one or both of an outer circumference and an inner circumference of the first storage space and has a second height along the direction of the central axis, the second height being at least twice the diameter of the cord, the second storage space being provided to allow the cord to be wound in a plurality of rows along the central axis; and a guide configured to align the cord in the second storage space.

6. The mechanism for winding a cord according to claim 5, wherein the guide projects outward in a radial direction about the central axis and extends in a circumferential direction, and a part of the guide in the circumferential direction is cut out by a slit through which the cord passes.

* * * * *